United States Patent [19]

Johnston

[11] 4,102,413

[45] Jul. 25, 1978

[54] ROCK DRILLING APPARATUS AND METHOD

[76] Inventor: Frederick Eric Johnston, 268 Cunningham Ave., Ottawa, Ontario, Canada

[21] Appl. No.: 720,707

[22] Filed: Sep. 7, 1976

[30] Foreign Application Priority Data

Aug. 30, 1976 [CA] Canada ..... 260105

[51] Int. Cl.[2] ..... E21B 9/22; E21B 21/00

[52] U.S. Cl. ..... 175/53; 175/210; 175/311

[58] Field of Search ..... 175/53, 122, 210, 311, 175/209, 211, 94; 299/56

[56] References Cited

U.S. PATENT DOCUMENTS

| | | | |
|---|---|---|---|
| 2,228,709 | 1/1941 | Ruddell et al. | 175/311 X |
| 2,746,719 | 5/1956 | Seligman | 175/53 |
| 3,045,769 | 7/1962 | Feucht et al. | 175/211 |
| 3,231,029 | 1/1966 | Winberg | 175/53 |
| 3,674,099 | 7/1972 | Kostylev et al. | 175/102 X |
| 3,811,518 | 5/1974 | Kalaf et al. | 175/209 |
| 3,830,318 | 8/1974 | Busby et al. | 175/53 X |
| 3,894,402 | 7/1975 | Cherrington | 175/53 X |

FOREIGN PATENT DOCUMENTS

| | | | |
|---|---|---|---|
| 238,246 | 9/1909 | Fed. Rep. of Germany | 175/311 |

*Primary Examiner*—Ernest R. Purser
*Assistant Examiner*—William F. Pate, III
*Attorney, Agent, or Firm*—Lawrence I. Field

[57] ABSTRACT

A method of drilling a large hole through rock and removing the drilling waste by drilling a pilot hole from one rock face to another, reverse drilling with a large drill bit and removing the waste during the reverse drilling by pressurizing the pilot hole to eject the waste through a muck extractor dragged behind the large drill bit; and an apparatus to carry out this method consisting of a sealing member for the one rock face, and a muck extractor for securement to the large drill bit.

12 Claims, 5 Drawing Figures

ROCK DRILLING APPARATUS AND METHOD

This invention relates to a rock drilling apparatus and method by which it is possible to rapidly drill large diameter holes in an accurate manner.

The apparatus is especially useful for drilling horizontal or near horizontal holes in rock of the type which, for instance, often are required beneath a highway or railway for carrying water pipes, electrical wiring, etc.

When requiring to insert pipes, wires or the like beneath a road, the present method is usually to excavate, drill and blast a trench through the road, roadbed and underlying bedrock, lay the pipe or the like, and then refill the trench. Such a procedure is obviously extremely disrupting to traffic which normally travels on the road and also involves the use of heavy digging machinery, blasting equipment, and road resurfacing equipment. Even when such a job is completed, the finished road surface above the filled trench is usually of a poorer quality than the remainder of the road surface.

Direct drilling of a large diameter hole has been attempted, however, because the drill bit is much larger than the drill rods and the required drill cutting pressure increases with an increase in diameter of the drill bit, the drill string will flex under the compressive load and permit the drill bit to drift from the required direction. It is therefore not possible to accurately drill a large hole by direct blind drilling.

Another method of drilling a horizontal hole is known in which a pilot hole has been drilled and a larger cutter with a means extending through the pilot hole has been pulled back, so enlarging the pilot hole. Such a method has only been used in earth as the cutter which has been used has not been rotatable and has been for the purpose of obtaining earth cores. A typical patent showing this type of method is U.S. Pat. No. 3,482,641 issued on Dec. 9, 1969 to S. G. Atkins et al. The apparatus for this patent is however of no use whatsoever in the drilling of large diameter holes in rock.

The only other method of making horizontal holes is by tunnelling which requires the dropping of shafts, drilling, and blasting or using large diameter tunnelling equipment, such as a tunnel boring machine, between the shafts. Tunnelling also requires that there be operators working inside the tunnel so that a formed tunnel is, of necessity, usually much larger than the purpose for which it is required.

There is therefore a requirement to be able to form a large diameter horizontal hole through rock which does not disturb the surface above the hole and which need only be drilled to a standard drill size, the size, or only slightly larger than the size required for the intended purpose.

The method of this invention is to dig a relatively short pit at each side of a roadway, for instance; install a drilling head in the entry pit, drill a horizontal pilot hole under the roadway to the other exit pit, install a large drill bit similar to a raise head on the exposed end of the drill string, and retract and bore out the pilot hole until the large drill bit is retrieved at the entry pit. While retracting the large drill bit and drilling the larger hole, the waste is forceably ejected preferably out of the large hole.

The apparatus to carry out this method consists of a drill head mounted on a frame which permits horizontal movement and can be adjusted vertically and a seal at the rock face in the entry pit where the drill head is located so that when drilling the pilot hole, waste can be fed from the seal and out of the entry pit and while drilling the large diameter hole, the space around the drill string can be sealed at the entry pit to pressurize the pilot hole. A muck extractor for removing the waste is dragged along behind the large diameter bit, when drilling the large diameter hole, in sealing contact with the large diameter hole, the extractor having an ejection pipe so that waste can be forced through the ejection pipe by utilizing the pressure formed in the pilot hole. A series of stabilizer and guiding sleeves are distributed along the drill string for accurately drilling the pilot hole and for accurately positioning the drill string when retracting it during drilling of the large diameter hole.

The muck extractor, in a modified form, can also be utilized for vertical or inclined blind hole drilling, the drill string passing through the extractor and being collared to it so that waste can be removed upwardly by the pressured fluids passing down the drill string.

The invention will now be described with reference to the accompanying drawings in which a preferred embodiment of the apparatus is shown.

In the drawings, FIG. 1 is a schematic diagram of an apparatus constructed according to this invention;

Figure 1:
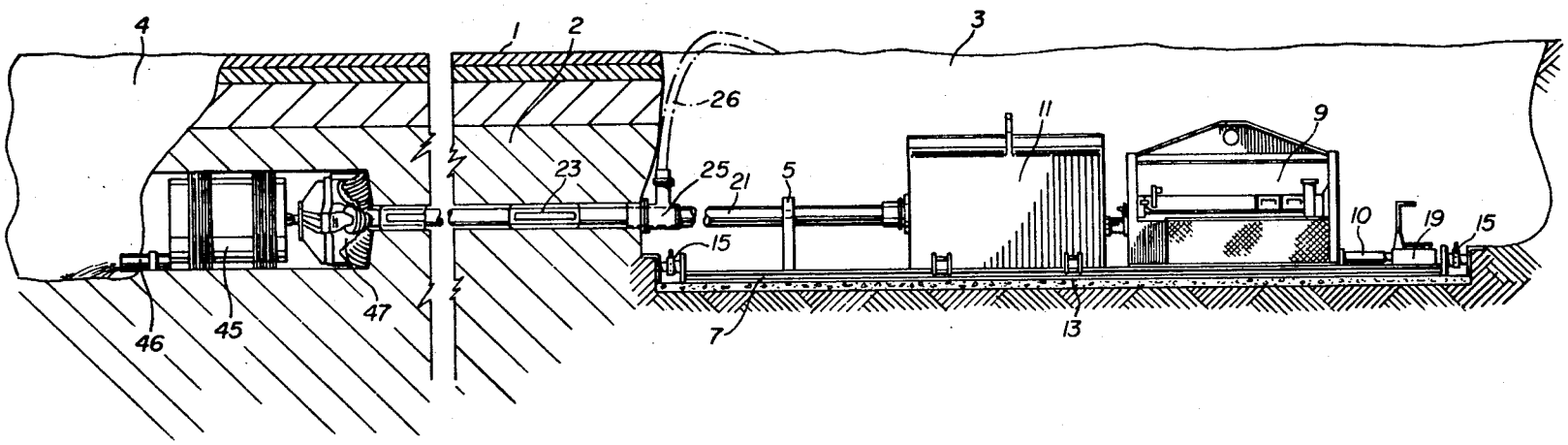

Referring specifically to FIG. 1, there is shown a roadway 1 and various strata layers including bedrock 2 beneath the roadway 1. An entry pit 3 is excavated by conventional drilling and blasting methods. I-beam rails are positioned on line and grade on the bottom of pit 3 and are embedded in concrete 13 with their upper flanges exposed, to form a secure base and an anchorage for a sub frame of power sorce 9 and a drill head 11. The sub frame (not shown) includes a locking mechanism 19 and hydraulic jacking means 10 (one only being shown) which are both of conventional form. To provide further stabilization of the rails 7, jacks 15 are provided between the ends of the rails and an angle 17, used as a bearing plate on a step of the bedrock.

The other item secured to the sub frame is a steady 5 having a breakout clamp which is used for attaching and detaching lengths of drill rod 21 and stabilizers 23. Both of these items are conventional, the stabilizers 23 merely being sleeves which can be inserted as required between lengths of drill rod for the purpose of guiding and stabilizing the drill rod. The sleeve is prevented from rotating by contact with the bore being produced and permits the drill rod to turn so functioning as a bearing for the rod. The diameter of the stabilizers 23 is also shown much greater than that of the rod 21 for the purposes of clarity, however, the actual difference in diameter is much less.

It is also practical, in order to remove the power source 9 from a wet environment, to locate the power source out of the entry pit 3 and on a skid or flat bed trailer or the like at road level. Hydraulic power lines can be run from the power source 9 down to the drill head 11 in the pit 3 and the jacking means 10 can be arranged if required to provide a longer power stroke so that longer drilling stretches can be accomplished between adjustments provided by the locking mechanism 19.

Figure 4:
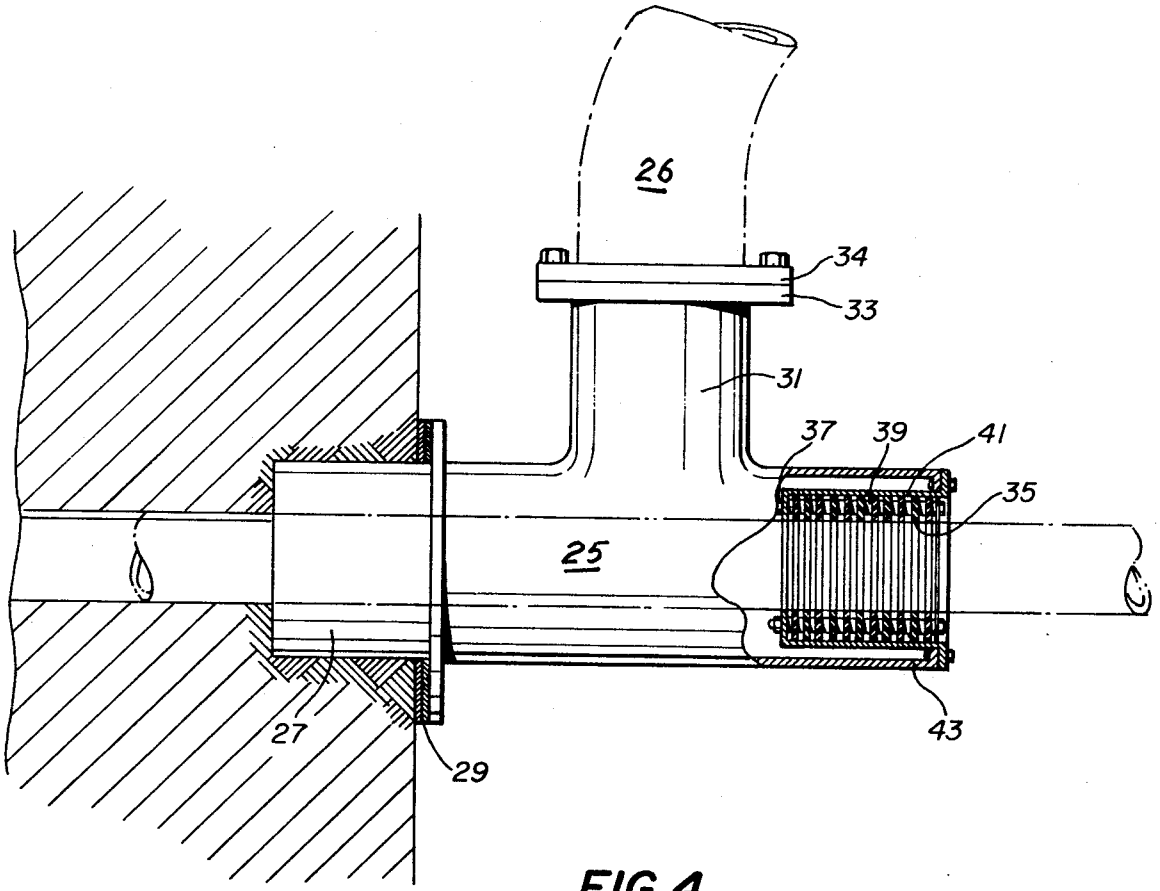
FIG. 4 is a schematic diagram of the rock face seal as shown in FIG. 1.
Figure 5:
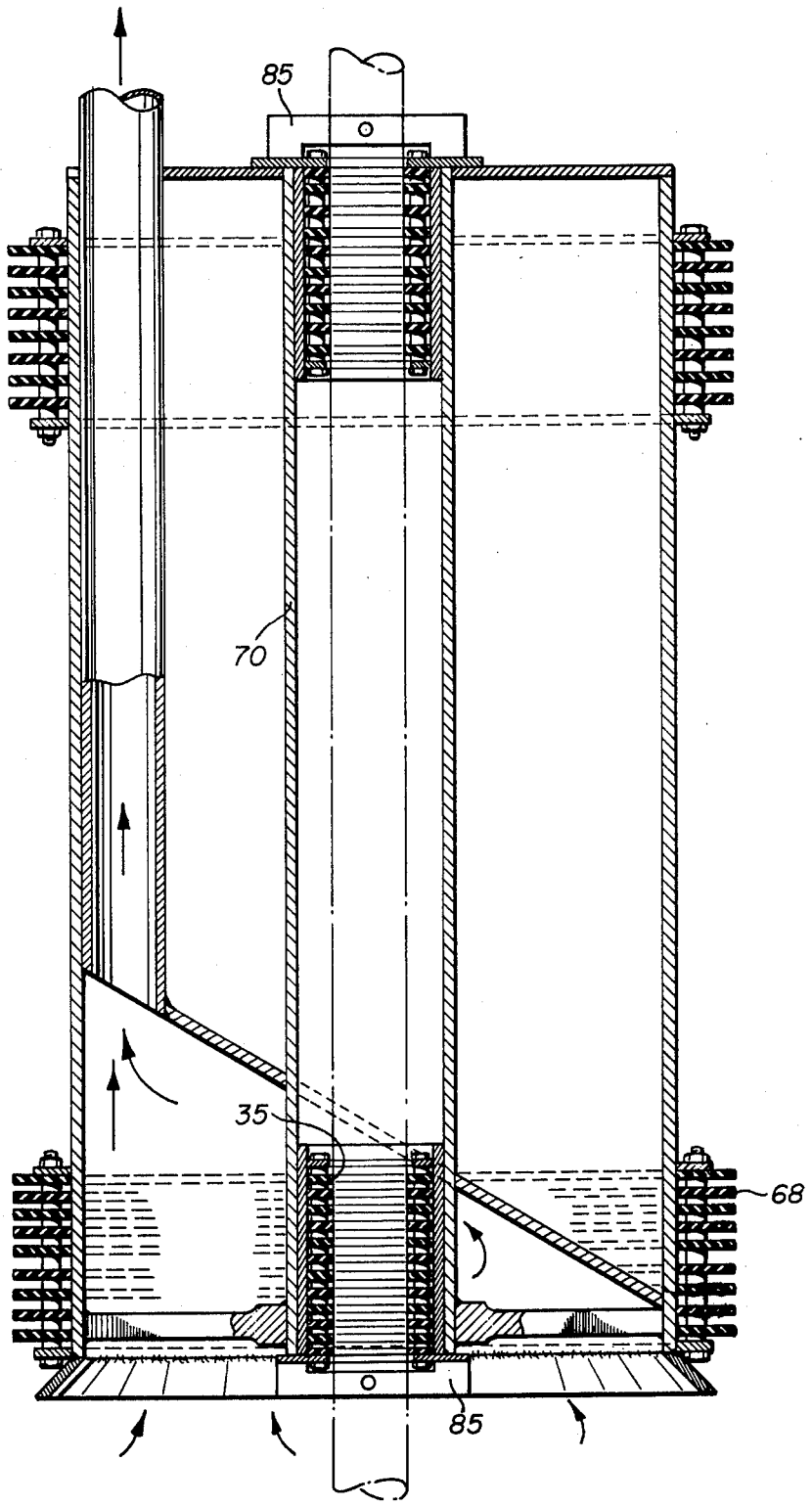
FIG. 5 is a schematic cross-sectional view of a type of muck extractor which can be used with a vertical or inclined drilling apparatus.

A sealing member 25, detailed in FIG. 4, is secured in the rock face of the entry pit 3 to effectively provide a seal against the drill rod 21 so that the cavity between the drill string and the drilled hole can be pressurized. The sealing member 25 has a flanged extension 27, which can be sealed in the rock face by grout and packing 29; and a T-pipe 31, having a flange 33. To seal against the drill rod, a series of resilient annular members 35 are stacked upon bolts 37 with cylindrical spacers 39 holding such annulus a set distance from the adjacent annulus. The stack of resilient members and spacers is held in an open cylindrical housing 41 which itself is bolted to a flange 43 of the body of the sealing member. In this manner, the resilient annular members can be removed and replaced without disconnecting the body of the sealing member from the rock face.

Figure 2:
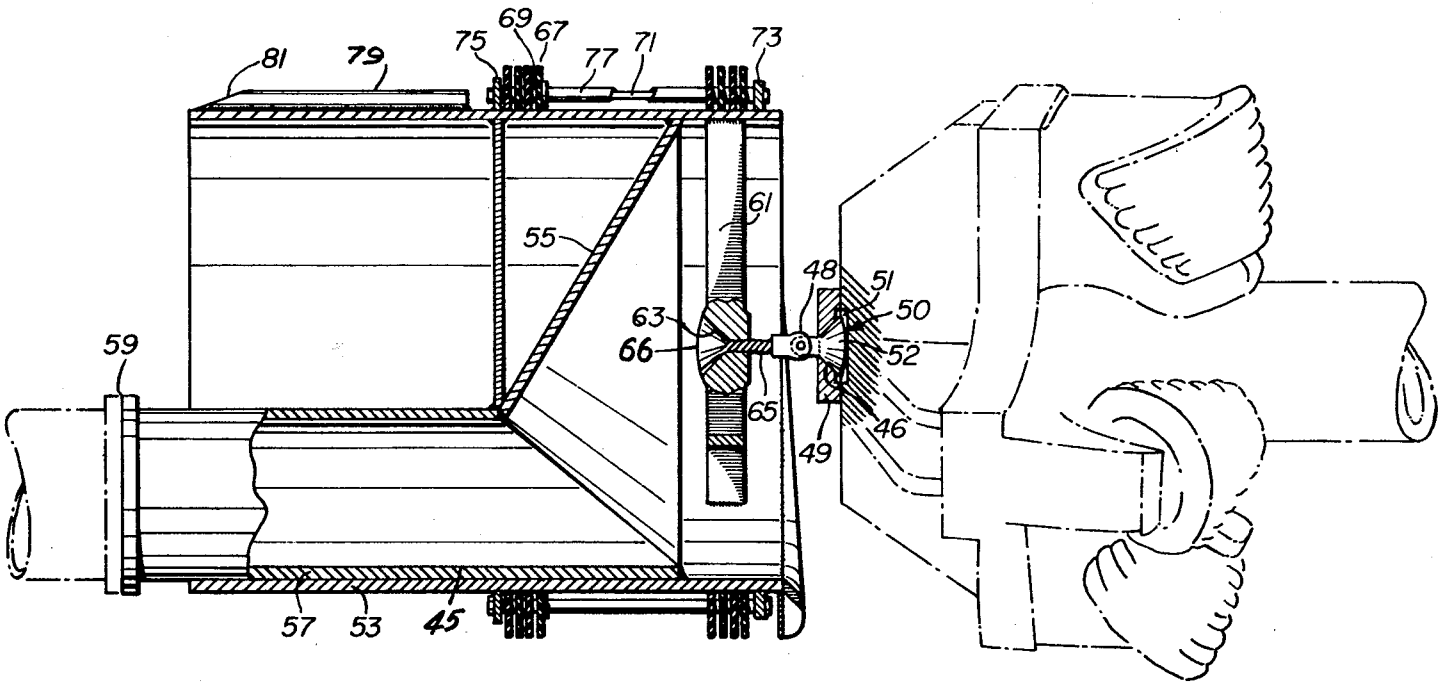
FIG. 2 is a schematic cross-sectional view of the muck extractor shown in FIG. 1, with a large drill head being shown in chain lines.
Figure 3:
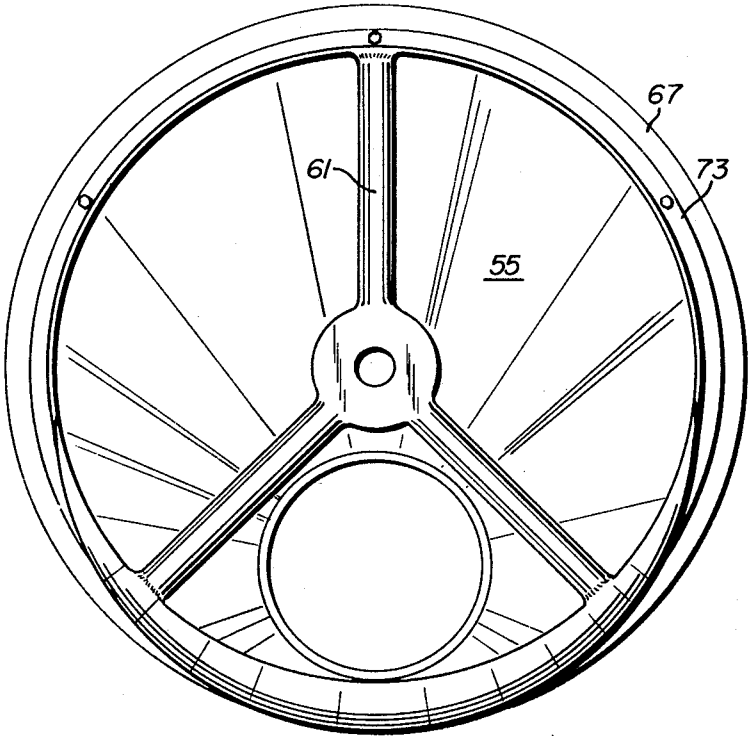
FIG. 3 is an end view of the extractor of FIG. 2.

When making the large hole, a muck extractor 45 is used, this being detailed in FIGS. 2 and 3. The muck extractor is secured to a conventional type of drill bit 47 by a flexible member such as wire rope 65. In the end of the drill bit there is formed a recess 51 over which a plate 49 is secured by bolting or the like. Plate 49 has a bevelled hole 46 through its centre through which a swivel member 50 passes. The swivel member 50 has a conical head 52 and a cylindrical extension 48 having a drilled transverse hole 63. Wire rope 65 is secured, by conventional socket means, between a conical head 66 and a shackle 78 having a threaded pin 80 which is used to secure shackle 78 to swivel member 50. The muck extractor consists of a cylindrical drum 53 having a conical shaped insert 55 welded therein and welded to a pipe 57 having an end flange 59 for receiving a snap-on type of coupling.

A number of radial arms 61 are welded in front of insert 55 and a central bevelled hole 63 is formed to accept conical head 66. It should be noted that other types of means could be used to secure the drill bit to the muck extractor, the requirement being that the drill bit must be able to rotate and pull along the muck extractor without rotating the extractor. At the front or right hand end of the extractor there is provided a series of annular resilient seals which consist of a number of replaceable annular parts 67 having spacers 69 which are over bolts 71 and are positioned by annular plates 75, welded to the outside of drum 53, with the other end of the bolts passing through a loose fitting annular ring 73. A relatively long intermediate spacer 77 holds apart two sections of the sealing member. A number of round section skids are welded along the remainder of the drum 53, each skid having an inclined end 81 which permits rearward movement of the extractor without binding in the drilled hole.

The apparatus of this invention is operated as follows.

A pit of relatively short length is excavated at each side of a roadway under which a hole is to be drilled. The rails 7 are positioned, the foundation concrete 13 is poured, and when set and ready, the power source 9 and the drill head 11 and its sub base are lowered onto the rails and operatively secured in place by bolting, for instance. A drill bit of slightly larger size than that to be used for a pilot hole is fed into the rock face a short distance to accommodate the flanged extension 27 of the sealing member 25. The sealing member 25 is then inserted into the rock face and grouted and sealed in place. A waste pipe 26 is secured to the flange 33 for discharging waste out of the entry pit. After the sealing member is secured to the rock face the pilot hole drill bit is secured to a stabilizer 23 and to a drill rod and is passed through the sealing member 25 to begin drilling of the pilot hole. The drill rod usually carries compressed air, and/or cooling liquid and additives such as a soluble oil, to the drill bit, and waste is carried back around the drill string and out through the sealing member 25 and the pipe 26. It is important to utilize a relatively large number of stabilizers 23 to achieve correct alignmemt of the pilot hole, the first stabilizer being directly behind the drill bit and other stabilizers being spaced along the drill string at even intervals as required to suit operating conditions. When the pilot hole breaks through into the exit pit 4 at the other side of the road, a large drill bit 47 of the raise head type is secured to the drill string to cut the required large hole. The muck extractor 45, as shown in FIG. 2, is secured to bit 47, the pipe 26 is removed from the sealing member 25, and a blank 34 is secured over flange 33. The operation of cutting the large hole is now commenced, the cutting mixture flowing through the drill string and pressurizing the space between the pilot hole and the drill string, such that waste is ejected through the muck extractor and shoots out through pipe 57. The muck extractor does not have any great tendency to rotate in the large drilled hole due to the skids 79 and the friction of the annular seals 67 against the hole walls. As required, extra lengths of discharge pipe 46 can be coupled onto the pipe 57 from the muck extractor so that all the waste is ejected into trench 4.

Alternatively, pipe 26 could be left in place and the cutting mixture could be made to flow through the pipe 26 and force waste out through the muck extractor, the drill string fluid feed being cut off; or the muck extractor pipe 46, 57 could be capped and the drill string fluid feed used to clean out waste from the drill bit 47, through pipe 26.

It is to be understood that the method of drilling both the pilot hole and the larger hole is by moving the subframe containing the power source 9 and the drill head 11 by the hydraulic jacks 10 and inserting or removing lengths of drill rod and stabilizers as required. This part of the method is well known in hole drilling operations and there is therefore believed to be no necessity for a detailed discussion of it.

It is thus seen that a very efficient method of drilling a large diameter hole has been devised and the efficiency of the method has been greatly increased by the use of a novel sealing member 25 and a novel muck extractor 45.

It is also to be understood that although discharge pipe 57 has been shown at one side of conical insert 55, if it is preferred, the discharge pipe could be located in any other position such as in a central position on the drum axis in which case a symmetrical cone insert would be utilized.

Any well-known type of screw auger could also be used as a muck extractor, being suitably secured to the large drill bit 47 for dragging through the large hole during drilling, but obviously such an arangement will not be as simple or efficient as the extractor shown in FIG. 2.

Regarding the embodiment of FIG. 4, this muck extractor is for use when drilling blind holes downward vertically or at an angle inclined to the vertical and provides a method of removing waste material in an efficient manner. The muck extractor is generally of the same for as that shown in FIG. 2, utilizing two separate sets of resilient annular seals 68 but having an axial tube 70 along the extractor, this tube being provided with inner annular seals similar to seals 35 as used in sealing member 25. A drill rod inserted through the axial tube 70 effectively seals one end of the extractor from the other end. If a drill bit is secured to the left-hand end of the drill rod, as shown in chain lines, and the extractor positioned on the rod by collars 85, when drilling, the fluids passing through the drill rod will force waste material back through the muck extractor and up through pipe 58.

The embodiments of the invention in which an exclusive property or privilege is claimed are defined as follows:

1. An apparatus for drilling and removing waste from a drilled hole comprising a drill head, a drill string driven by the drill head, a drill bit located at the remote end of the drill string, a sealing member positionable around the drill string and securable to a face of a rock body through which the hole is to be drilled and a non-rotatable muck extractor securable to the drill bit so that it can be dragged along behind the bit during a reverse drilling operation wherein the muck extractor consists of a cylindrical drum having a frusto conical shaped insert secured therein, and annular resilient sheets around the drum to form, during use, a seal with the hole being drilled during the reverse drilling operation.

2. The apparatus of claim 1, wherein the insert has a waste removal pipe secured at its small end for carrying waste from the insert to a location distant from the drill bit.

3. The apparatus of claim 1, wherein the annular resilient sheets are stacked at one end of the drum, each sheet being spaced from its adjacent sheet by spacers.

4. The apparatus of claim 3, wherein the resilient sheets and spacers are held as a unit by a fixed outer projecting flange at one end of the sheets through which a series of circumferentially spaced bolts passes, the bolts passing through the resilient sheets and the spacers.

5. The apparatus of claim 1, wherein a number of radially oriented arms are secured inside the drum ahead of the insert, the arms meeting at a central boss which is provided with an axial aperture for accommodating a flexible member secured to a drill bit.

6. A muck extractor for removing waste from a drilled hole consisting of a cylindrical drum having a solid cylindrical wall and an open leading end, a frusto conical shaped insert secured therein with its largest end towards said leading end and abutting to the inner surface of said wall, and annular resilient sheets at right angles to and around said wall to form, during use, a seal with the inner surface of the hole being drilled.

7. The muck extractor of claim 6, wherein the insert has a waste removal pipe secured to its smallest end for carrying waste from the insert to a location distant from the drill bit.

8. A muck extractor for removing waste from a drilled hole consisting of a cylindrical drum having a frusto conical shaped insert secured therein, a waste removal pipe secured at the small end of said insert for carrying waste from the insert to a location distant from the drill pipe and annular resilient sheets around the drum to form during use a seal with the hole being drilled, wherein the annular resilient sheets are stacked at one end of the drum each sheet being spaced from its adjacent sheet by spacers.

9. The muck extractor of claim 8, wherein the resilient sheets and spacers are held as a unit by a fixed outer projecting flange at one end of the sheets through which a series of circumferentially spaced bolts passes through the resilient sheets and the spacers.

10. The muck extractor of claim 9, wherein the trailing end of the drum is closed and an axially aligned pipe is secured from one end of the drum to the other for accommodating a drill.

11. The muck extractor of claim 10, wherein a seal is secured inside each end of the axially aligned pipe.

12. The muck extractor of claim 11, wherein each seal includes a number of annular resilient sheets stacked upon a series of circumferentially spaced bolts.

* * * * *